US012403515B2

(12) United States Patent
Wendt et al.

(10) Patent No.: US 12,403,515 B2
(45) Date of Patent: Sep. 2, 2025

(54) METHOD FOR AUTOMATICALLY CALIBRATING VERTICAL ROLLERS OF A VERTICAL ROLLER FRAME AND CALIBRATION ARRANGEMENT FOR CARRYING OUT SAID METHOD

(71) Applicant: SMS group GmbH, Düsseldorf (DE)

(72) Inventors: Stefan Wendt, Hilchenbach (DE); Ralf Setzer, Hilchenbach (DE)

(73) Assignee: SMS group GmbH, Düsseldorf (DE)

( * ) Notice: Subject to any disclaimer, the term of this patent is extended or adjusted under 35 U.S.C. 154(b) by 163 days.

(21) Appl. No.: 17/796,793

(22) PCT Filed: Feb. 5, 2021

(86) PCT No.: PCT/EP2021/052778
§ 371 (c)(1),
(2) Date: Aug. 1, 2022

(87) PCT Pub. No.: WO2021/156424
PCT Pub. Date: Aug. 12, 2021

(65) Prior Publication Data

US 2023/0048632 A1 Feb. 16, 2023

(30) Foreign Application Priority Data

Feb. 6, 2020 (DE) ..... 10 2020 201 445
Oct. 20, 2020 (DE) ..... 10 2020 213 239

(51) Int. Cl.
*B21B 38/10* (2006.01)
*B21B 13/06* (2006.01)

(52) U.S. Cl.
CPC ..... *B21B 38/105* (2013.01); *B21B 13/06* (2013.01); *B21B 2273/22* (2013.01)

(58) Field of Classification Search
CPC ... B21B 38/105; B21B 13/06; B21B 2273/22; B21B 2261/06
(Continued)

(56) References Cited

U.S. PATENT DOCUMENTS

2018/0326466 A1* 11/2018 Wendt ..... B21B 13/06

FOREIGN PATENT DOCUMENTS

CN 102688904 A 9/2012
CN 102989792 A 3/2013
(Continued)

OTHER PUBLICATIONS

English translate (CN209310738U), retrieved date Apr. 27, 2024.*
(Continued)

*Primary Examiner* — Mohammed S. Alawadi
(74) *Attorney, Agent, or Firm* — Maier & Maier, PLLC

(57) ABSTRACT

A method for the automatic calibration of vertical rolls of a vertical rolling stand, each of which is supported in a vertical roll unit which is adjustable with respect to a predetermined center line of a plurality of components arranged in a rolling train, including the steps of a) moving the vertical roll units into a calibration position transverse to the center line against at least one stationary stop of the vertical rolling stand, which has a certain known position with respect to the center line, b) calculating a calibrated initial distance $A_{kal}$ between an outer edge of a vertical roll facing a rolled stock or the center line and the center line in the calibration position, and c) adjusting the vertical roll units to a defined operating position.

20 Claims, 2 Drawing Sheets

(58) Field of Classification Search
USPC ..... 72/224–225, 199–252.5
See application file for complete search history.

(56) References Cited

FOREIGN PATENT DOCUMENTS

| | | | | | |
|---|---|---|---|---|---|
| CN | 103316925 | A | | 9/2013 | |
| CN | 203778497 | U | | 8/2014 | |
| CN | 106040753 | A | | 10/2016 | |
| CN | 106040753 | B | * | 6/2018 | ..... B21B 38/10 |
| CN | 108348968 | A | | 7/2018 | |
| CN | 110153203 | A | * | 8/2019 | |
| CN | 209310738 | U | * | 8/2019 | ..... G01B 11/02 |
| JP | H08192203 | A | | 7/1996 | |
| JP | 2012-218060 | A | | 11/2012 | |
| JP | 5720391 | B2 | * | 5/2015 | |
| JP | S59153509 | A | * | 5/2015 | |
| KR | 10-1562125 | B1 | | 10/2015 | |
| WO | 2010109637 | A1 | | 9/2010 | |

OTHER PUBLICATIONS

English translate (CN110153203A), retrieved date Apr. 27, 2024.*
English translate (CN106040753B), retrieved date Apr. 27, 2024.*
English translate (JPS59153509A), retrieved date Nov. 17, 2024.*
English translate (JP5720391B2), retrieved date Nov. 17, 2024.*
International Search Report mailed on May 26, 2021, in corresponding International application No. PCT/EP2021/052778; 7 pages (with English Translation).
Written Opinion of the International Searching Authority mailed on May 26, 2021, in corresponding international Application No. EP2021/052778; 8 pages.
Office Action issued on Jul. 14, 2023, in corresponding Japanese Application No. 2022-547869, 10 pages.
Office Action issued on Jul. 24, 2024, in corresponding Chinese Application No. 202180013149.1, 16 pages.

* cited by examiner

METHOD FOR AUTOMATICALLY CALIBRATING VERTICAL ROLLERS OF A VERTICAL ROLLER FRAME AND CALIBRATION ARRANGEMENT FOR CARRYING OUT SAID METHOD

FIELD

The invention relates to a method for the automatic calibration of vertical rolls or vertical rolls (hereinafter referred to only as vertical rolls) of a vertical rolling stand for rolling metal flat products, in particular for rolling steel and non-ferrous metals.

BACKGROUND

Calibration of a vertical rolling stand is necessary to determine and, if necessary, correct the position of the vertical rolls with respect to the center of the rolling train so that the outer edges of the vertical rolls facing the center of the rolling train are at the same distance from the center line of the rolling train. Calibration may be necessary, for example, whenever the vertical rolling stand is put back into operation after a repair, when the rolling train is restarted after a standstill, or after a loss of signal from the control system, or when the rolling result suggests a correction of the position of the vertical rolls.

Various methods for calibrating vertical rolling stands are known in the prior art. In prior art methods, calibration of vertical rolls in vertical rolling trains is performed using measuring aids, such as tape measures, laser range finders, or other measuring devices used by operators on the machine or attached to it for calibration. This usually involves measuring a distance from a fixed point on the machine to the respective vertical roll or to a point assigned to it, or measuring the distance between both vertical rolls or these assigned points in order to determine and, if necessary, correct the position of the vertical rolls. This procedure has the particular disadvantage that persons must be present in the machine area and thus in the hazardous area during the calibration process.

Another disadvantage of the known methods for calibration in vertical rolling trains is that the known methods cannot be automated and are relatively time-consuming, which significantly reduces plant availability.

The problem of the measurements that may be required in the machine area is described in CN 102688904 A, in which a calibration method is proposed that is carried out by means of a wire looped around hub-shaped heads of vertical rolls.

Also known from CN 102989792 A is a method for calibrating the vertical rolling gap of a vertical rolling stand. The method includes determining and marking the center line of the rolling train for each of the upper and lower ends of the vertical rolls, determining the distance of the axes of the vertical rolls from the marked center line, and vertically aligning the ends of the vertical rolls with the marked center line. Then, the distance of the lower ends of the vertical rolls to the lower end of the marked center line is compared with the distance of the upper ends of the vertical rolls to the upper end of the marked center line. This is used to set the vertical alignment and centering of the vertical rolls, and then to calibrate by measuring the width of the rolling gap. How exactly the distances are measured is not described in this publication.

JP 2012218060 A describes a method in which the position of the vertical rolls in a vertical rolling stand is determined exclusively by means of sensors or position sensors arranged on the actuating cylinders and on the return cylinders of the vertical roll units.

The present invention is based on the problem of providing a method and an arrangement for carrying out the method, with which the calibration of vertical rolling stands can be automated as far as possible without the need for personnel to be present in the stand area.

SUMMARY

According to one aspect of the invention, a method is proposed for the automatic calibration of vertical rolls of a vertical rolling stand, wherein the vertical rolls are each mounted in a vertical roll unit which is adjustable with respect to a predetermined center line of several components of the rolling train arranged in a rolling train, for example roll stands, side guides, roller tables, etc., in which first the vertical roll units are moved or adjusted transversely to the center line of the rolling train against at least one stationary stop of the vertical rolling stand, which has a certain known position with respect to the center line. This position of the vertical roll units is referred to below as the calibration position. The stop can be designed, for example, as a reference surface that was measured and aligned with respect to the center line when the vertical rolling stand was erected in the rolling train.

Based on the position of the vertical roll units determined in this way, a calibrated initial distance is calculated between an outer edge of a vertical roll directed towards a rolled stock and the center line in the calibration position. The vertical roll units are then moved from the calibration position to an operating position. The adjustment distance to be covered is specified or calculated for each vertical roll or for each vertical roll unit, taking into account the calibrated initial distance.

This process can be fully automated and does not require any manual measuring operations in the danger zone of the vertical rolling stand. The method according to the invention provides, on a vertical rolling stand, reference surfaces on the movable vertical roll units or on adjacent or connected components on the one hand and measuring surfaces or reference surfaces on stationary components of the vertical rolling stand on the other hand. The position of these reference surfaces relative to the position of the outer edges of the rolled stock or the outer edges of the vertical rolls facing the rolled stock can be determined relatively easily, as can the position of the reference surfaces relative to each other and to the center line of the rolling train. The reference surfaces on the movable assemblies of the vertical rolling stand can be moved against reference surfaces of the stationary assemblies in order to determine a defined starting position for further adjustment movements, so that they are in contact and a further change in position is no longer possible.

In an expedient variant of the method, it is provided that in each case a calibration process is carried out for a first vertical roll unit and for an associated second vertical roll unit, wherein the first and the second vertical roll unit are moved into the operating position after the calibration process with respect to the center line in such a way that the outer edges of the first and second vertical roll facing the rolled stock are at the same distance from the center line.

In the context of the present application, a distinction is made between an operating position and a calibration position of the vertical roll units. The operating position within the meaning of the present application is to be understood as the position of the vertical roll units which they assume as the nominal position when the vertical rolling stand is in operation. The calibration position within the meaning of the present invention is, as mentioned above, the position of the vertical roll units in which at least one reference surface on a movable part of the vertical rolling stand is in contact with a reference surface of a stationary or fixed part of the vertical rolling stand when the vertical rolling stand is not in rolling operation.

Preferably, the calibration process is carried out separately for each vertical roll and independently of the calibration process of the respective other vertical roll.

In an advantageous variant of the method according to the invention, it is provided that the calculation of the calibrated initial distance is in each case based on a given diameter of the vertical rolls. This given diameter may have been calculated starting from a nominal diameter, taking into account a wear-related change during the rolling process, and used as the basis for calculating the calibrated initial gap.

Each reference surface on a moving component of the vertical rolling stand is assigned a reference surface on a stationary component of the vertical rolling stand. The stationary components of the vertical rolling stand are, for example, transverse heads, uprights and upper and lower roll beams.

The position of the reference surfaces on movable components of the vertical rolling stand are determined and known with regard to the distance of the outer edge of the vertical roll directed towards the rolled stock. The position of the reference surfaces on stationary components of the vertical rolling stand are known and determined with regard to the distance to the center line of the rolling train.

In the case that both the stationary reference surface and the movable reference surface are located on the side of the vertical roll facing the rolled stock, the actual distance to be calibrated from the center line of the rolling train to the outer edge of a vertical roll facing the rolled stock can be calculated using the following formula:

$$A_{kal}=f(A_{stat},A_{bew},D_W)$$

$$A_{ka}|=A_{stat}+A_{bew}-D_W/2$$

wherein $A_{kal}$ denotes the calibrated initial distance of the outer edge of the vertical roll facing the rolled stock from the center line of the rolling train, $A_{stat}$ denotes the distance of the stationary reference surface from the center line of the rolling train, $A_{bew}$ denotes the distance of the movable reference surface from the center line of the vertical roll, and $D_W$ denotes the diameter of the vertical roll.

The calibrated total opening of the vertical rolling stand results from the sum of the individual calibration results for a first side, for example for a drive side, and for a second side, for example for an operating side of the vertical rolling stand.

The above calculation assumes that the calibration position is on the side of the vertical rolls facing the rolled stock. Equally functional and technically possible within the scope of the invention is a calibration position, which is located respectively on the outer areas of the vertical rolling stand. In this case, the reference surfaces would each be located on the outer areas of the vertical rolling stand. Then the reference surfaces would touch, which can be provided, for example, stationary on the transverse heads on the one hand and movable on the traverses on the other.

The adjustment of the vertical roll unit into the calibration position and/or the setting of the vertical roll unit into the defined operating position is expediently carried out by means of at least one adjustment system and/or by means of at least one return system.

The adjustment system can comprise at least one translationally moved element, for example an actuating cylinder or an actuating screw. Likewise, the return system may comprise at least one translationally moved element in the form of a screw drive or a return cylinder.

Although the adjustment system and/or the return system can in principle be designed as mechanical systems, they are preferably designed as hydraulic systems comprising corresponding piston-cylinder arrangements.

The adjustment of the vertical roll unit into a defined operating position is expediently carried out by means of the at least one adjustment system and/or by means of the at least one return system.

The calibration process is preferably monitored via at least one measuring element, for example via a position sensor, in order to be able to carry out a nominal/actual comparison of the actual position and the desired position of the vertical rolls. For this purpose, at least one position sensor can be provided in and/or on the adjustment system.

For example, reaching the defined operating position of the vertical roll unit can be monitored by means of at least one measuring element by means of at least one position sensor, preferably on at least one hydraulic piston/cylinder arrangement of the at least one hydraulic adjustment system and/or the at least one hydraulic return system.

A preferred variant of the method is characterized in that the method step a) comprises that first at least one first reference surface of defined position on a vertical roll unit or on a component adjacent to the vertical roll unit and movable with the vertical roll unit is brought into contact with at least one second reference surface of defined position fixed with respect to the center line on the vertical rolling stand, preferably with the application of an actuating force. Such a movable component can be, for example, a traverse or a chock of the vertical rolling stand.

The displacement of the vertical roll unit according to method step a) can be carried out over a first travel distance at an increased speed and over a second travel distance at a reduced speed until the first and second reference surfaces touch each other.

Thereafter, an increase in the actuating force is preferably provided for measuring surfaces that are in contact with each other, followed by a resetting of the vertical roll unit with associated moving components to a defined unloaded position. The increase of the actuating force as well as the duration of the action are limited in each case.

The actuating force of the reference surfaces in contact with each other can be monitored by means of at least one pressure transmitter on at least one piston-cylinder arrangement of the hydraulic adjustment system and/or the hydraulic return system and limited to a predefined maximum value. The pressure transmitter acts like a limit switch. If a mechanical adjustment system is provided, at least one pressure transmitter in the form of a pressure cell can be provided to monitor and limit the actuating force.

When the reference surfaces on the movable and stationary components of the vertical rolling stand are arranged relative to each other in such a way that they have reached a position in which the reference surfaces are in contact with each other in such a way that a further change in position is impossible, the actual position of an outer edge of the vertical roll directed towards the rolled stock can be compared with a nominal position.

The calibration method can be carried out when the rolled stock has left the vertical stand, e.g during a rolling break, in the repair store or during maintenance. If the vertical roll units are moved to a calibration position transverse to the center line of the rolling train against stops of the vertical rolling stand provided on the transverse heads of the roll stand, the calibration method can also be carried out when the rolled stock is inside the roll stand.

A further aspect of the invention relates to a calibration arrangement on a vertical rolling stand in a rolling train for rolling metal products, preferably for carrying out the above-described method, with at least two vertical rolls each mounted in vertical roll units, which define a rolling gap and which are adjustable by means of at least one preferably hydraulic adjustment system and/or at least one preferably hydraulic return system with respect to a predetermined center line of a plurality of components of the rolling train arranged in the rolling train, wherein the calibration arrangement comprises at least one first reference surface of defined position on at least one vertical roll unit or on adjacent components or components connected therewith which is movable with the vertical roll unit and comprises at least one second reference surface stationary with respect to the center line, and a control system with which, by means of at least one position sensor of the adjustment system and/or of the return system, an adjustment of the vertical roll units transversely to the center line against the second reference surface can be effected as a stationary stop of the vertical rolling stand for determining a calibrated starting position and for calculating a calibrated initial distance between an outer edge of a vertical roll directed towards a rolled stock and the center line, and an adjustment of the vertical roll units into a defined rolling position.

The vertical rolling stand in which the method according to the invention is provided and on which the calibration arrangement according to the invention is provided does not necessarily have to comprise a return system.

A return system is only required if the adjustment system is not firmly connected to the traverse or chocks. A movement of the adjustment system across the center line then also causes a movement of the chocks. However, movement in the direction of the transverse heads does not cause a corresponding movement of the chocks. In such a case, a return system is provided that allows the chocks to follow the movement of the adjustment system. In the case of the vertical rolling stand, the adjustment system can be firmly connected to the traverse or chocks. In such a case, a separate return system is not required. The adjustment system then also assumes the function of the return system.

In a practical embodiment of the calibration arrangement according to the invention, it is provided that at least one first reference surface is arranged on at least one upper and/or one lower chock of the vertical rolls, and that preferably at least one second stationary reference surface is provided on at least one upper and/or one lower roll beam of the vertical rolling stand.

Another useful embodiment of the calibration arrangement provides that at least one first reference surface is arranged on a component adjacent to or connected to the vertical roll unit, for example the traverse, and that at least one second reference surface is provided on the respective corresponding transverse head of the vertical rolling stand.

Preferably, at least one of the first and/or second reference surfaces is adjustable with respect to its position.

It is expedient that the at least one first reference surface and/or the at least one second reference surface are designed as adjustable and/or replaceable measuring plates.

Furthermore, the calibration arrangement according to the invention preferably comprises at least one position sensor for monitoring the position of the vertical roll units.

In addition, at least one pressure transmitter can be provided, via which an actuating force of the at least one first reference surface can be limited against the at least one second reference surface.

BRIEF DESCRIPTION OF THE FIGURES

The invention is explained below with reference to an exemplary embodiment shown in the drawings.

Showing.

DETAILED DESCRIPTION

Figure 1:
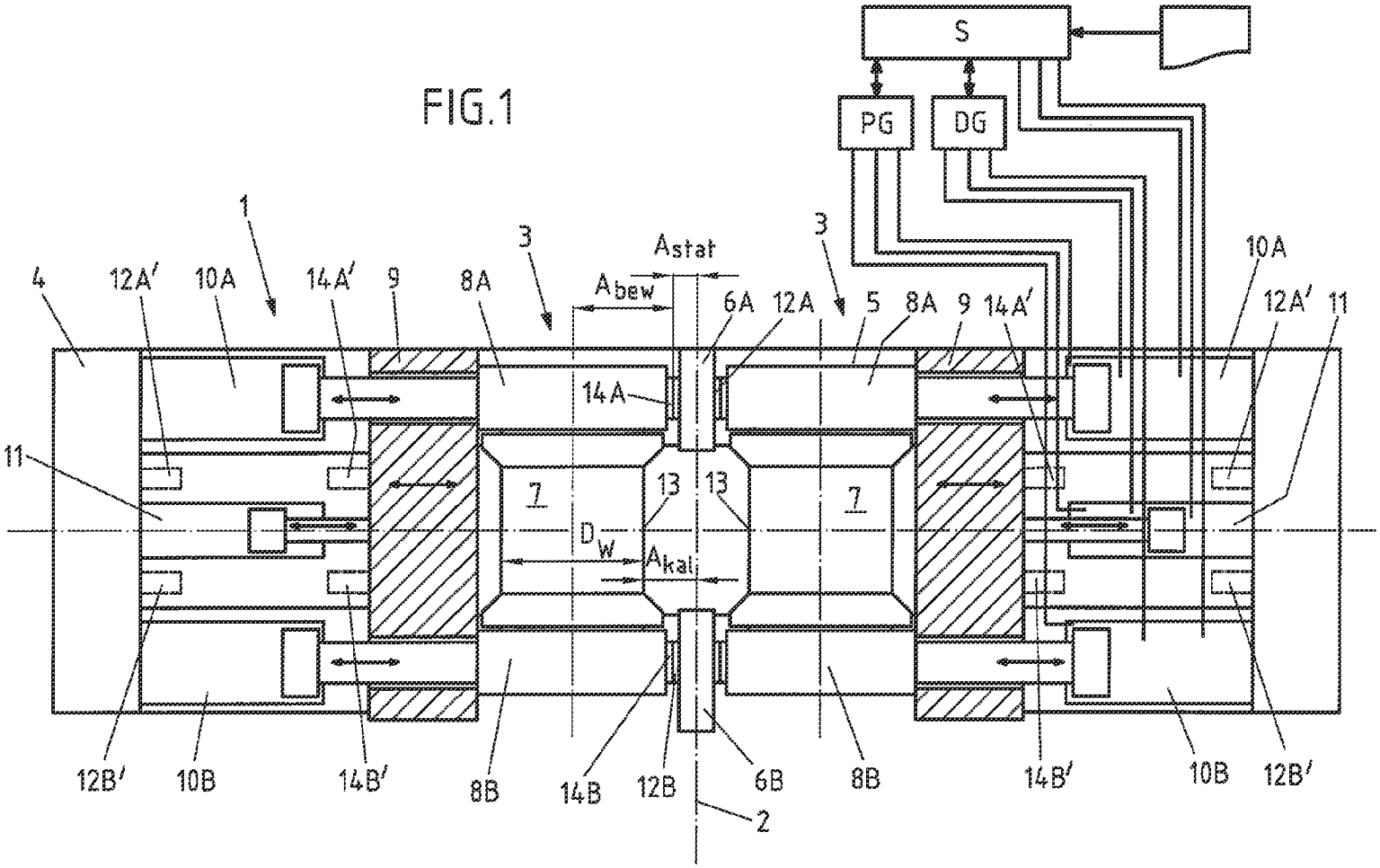
FIG. 1 a schematic view of a vertical rolling stand with a calibration arrangement according to the invention, partially in section and viewed in the direction of passage of the rolled stock, and FIG. 2 a top view of the vertical rolling stand shown in FIG. 1, partially in section.
Figure 2:
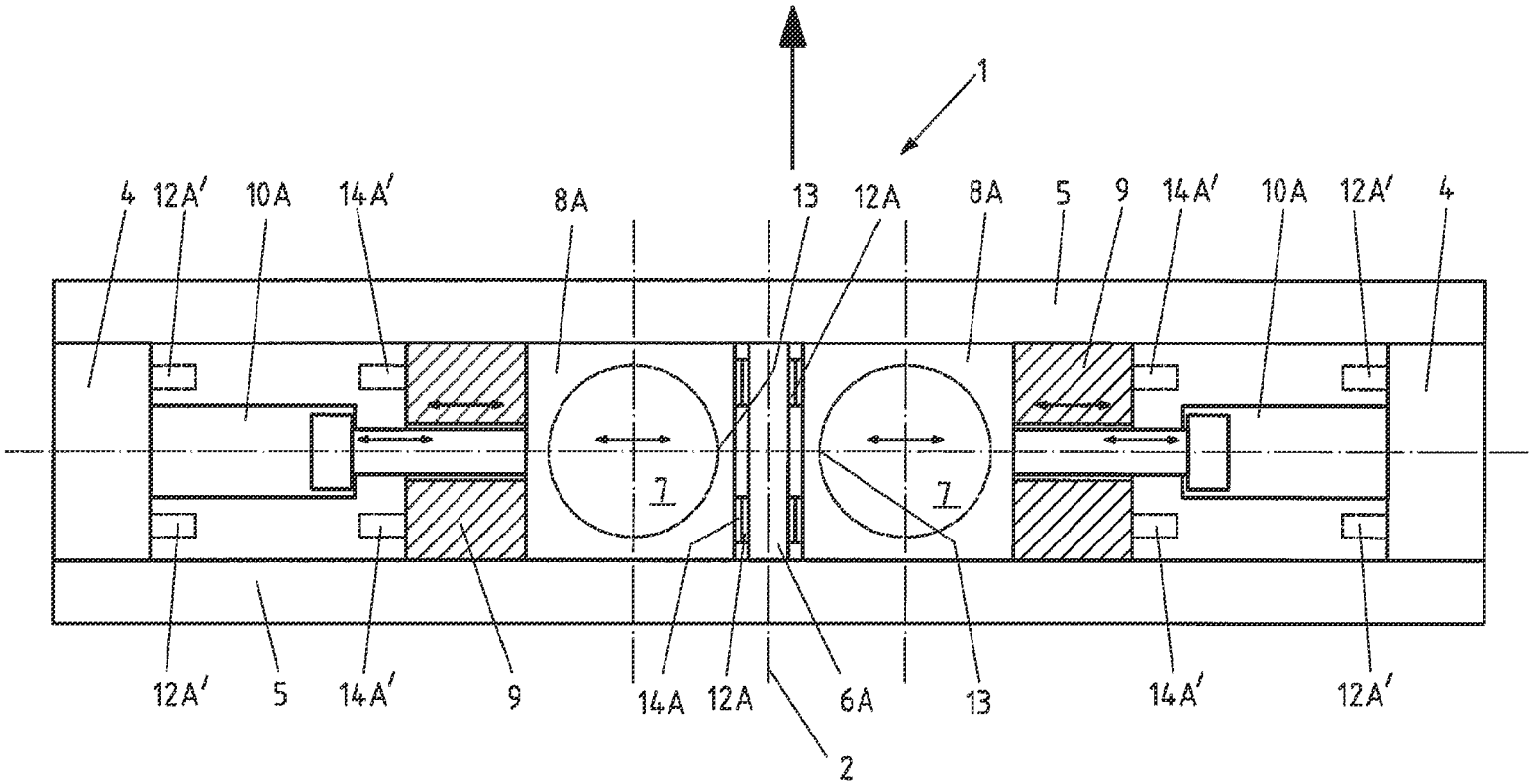

The vertical rolling stand 1 with the calibration arrangement according to the invention comprises two vertical roll units 3 adjustably arranged in a stationary roll stand. The rolling stand is aligned with respect to a center line 2 of several components of a rolling train arranged in a rolling train, for example roll stands, side guides, roller tables, etc. The drawing shows the transverse heads 4, the uprights 5 and the upper and lower roll beams 6A and 6B of the vertical rolling stand 1. The vertical roll units 3 each comprise a vertical roll 7 supported in an upper chock 8A and a lower chock 8B. The chocks 8A, 8B are each connected to each other by traverses 9 and are adjustable with the traverses 9 relative to each other and with respect to the center line 2. The vertical roll units 3 are adjusted by means of an adjustment system and a return system. The adjustment system comprises an upper and a lower adjustment cylinder 10A, 10B on each side of the vertical rolling stand 1 (operating side and drive side), which act on the upper and lower chocks 8A, 8B, respectively.

The return system comprises a return cylinder 11 on each side, each of which is operatively connected to the traverse 9. The traverses 9 can be moved together with the chocks 8A, 8B.

FIG. 1 shows the vertical rolling stand 1 not in rolling operation, namely with a position of the vertical roll units 3 in which they are in the calibration position, in which the vertical roll units 3 are moved in the direction of the center line 2 of the rolling train against a stationary stop of the vertical rolling stand 1. The stationary stop is formed by stationary reference surfaces that have a specific and known position with respect to the center line 2, against which movable reference surfaces rest on the vertical roll units 3 in the position shown in FIG. 1. In the described embodiment, the stop is formed by fixed or stationary measuring plates 12A and 12B, respectively, provided on either side of the upper roll beam 6A and the lower roll beam 6B. For the operation of the calibration arrangement, it is sufficient to provide only stationary measuring plates 12 on the upper roll beam 6A or on the lower roll beam 6B.

On the upper chocks 8A and on the lower chocks 8B of the vertical roll units 3, upper and lower movable measuring plates 14A, 14B are provided respectively on the side of the chocks 8A, 8B facing the center line 2 as movable reference surfaces. These movable measuring plates are attached to the respective chock 8A, 8B, adjustably if necessary, and are movable together with the chocks 8A, 8B. The stationary measuring plates 12A, 12B have a certain known position with respect to the center line 2, the movable measuring plates 14A, 14B have a known certain position with respect to the outer edges 13 of the vertical rolls 6 facing the rolled stock.

As already mentioned at the beginning, the outer edges 13 of the vertical rolls 7 directed towards the center line 2 should have the same distance to the center line 2 of the rolling train when the vertical rolling stand 1 is in operation, i.e. in the operating position of the vertical roll units 3. For this purpose, calibration of the vertical rolling stand 1 is required.

According to the invention, automatic calibration is provided including the adjustment system and the return system of the vertical rolling stand 1. The adjustment system and the return system or the associated actuating cylinders 10A and 10B and return cylinders 11 are controlled via a control system S. At least one of the actuating cylinders 10A comprises a position sensor PG, via which a nominal/actual comparison of the actual position and actuated position of the vertical roll 7 concerned can be carried out in the control system S. Furthermore, a pressure transmitter DG is provided, which can monitor the pressurization of the return cylinder 11. A pressure transmitter DG can be provided alternatively or additionally on one or more actuating cylinders 10A, 10B. Automatic calibration according to the invention is performed separately for each side of the vertical rolling stand 1 (operating side and drive side) and independently of the other side. The sensors required for this are provided on each side of the vertical rolling stand 1. In FIG. 1, however, only one control, position monitoring and pressure monitoring is shown for one side. The embodiment example is to be understood as providing such control, position monitoring and pressure monitoring for each of the sides of the vertical rolling stand 1.

To determine a calibrated distance or initial distance $A_{kal}$, the control system S first causes the upper and lower chocks 8A, 8B to be adjusted in the direction of the center line 2 with the aid of the actuating cylinders 10A, 10B and the return cylinder 11 until the movable measuring plates 14A, 14B rest against the stationary measuring plates 12A, 12B when the vertical rolling stand 1 is not in rolling operation. This adjustment movement takes place over a first distance at a relatively high speed and over a second distance at a relatively low speed with the application of a predefined setting force, the increase in which is monitored via the pressure transmitter DG. The process is terminated when the pressure detected by the pressure transmitter DG exceeds a preset value. This detects the end position of the vertical roll unit 3 in the calibration position. In this position, the distances $A_{stat}$ and $A_{bew}$ are determined and known, so that the calibrated initial distance $A_{kal}$ from the outer edge 13 of the vertical rolls 6 facing the rolled stock or the center line to the center line 2 can be calculated from this according to the formula $A_{kal}=A_{stat}+A_{bew}-D_W/2$. This calculation includes the diameter $D_w$ of the vertical roll, which is preferably calculated on the basis of a nominal diameter taking into account a wear-related change during the rolling process and stored in the control system S.

Starting from this calibrated initial distance, the same distance to the center line 2 specified for the operating position of the vertical roll units 3 can be set in each case.

It is equally functional and technically possible within the scope of the invention, as already mentioned at the introduction, to provide alternatively or additionally a calibration position, which is located in each case at the outer areas of the vertical rolling stand 1. In this case, the reference surfaces are each located on the outer areas of the vertical rolling stand 1. This is only indicated in the figures with dashed lines. The upper and lower movable measuring plates in this alternative embodiment are designated 14A' and 14B'. In this alternative embodiment, the upper and lower stationary measuring plates are designated 12A' and 12B'. In the alternative embodiment, the upper and lower movable measuring plates 14A' and 14B' are provided on the sides of the traverses 9 facing away from the vertical rolls 7. The upper and lower stationary measuring plates 12A' and 12B', on the other hand, are provided on the sides of the transverse heads 4 of the vertical rolling stand 1 facing the vertical rolls 7. It follows that a calibration position is the position in which the vertical rolls 7 are fully extended.

LIST OF REFERENCE NUMBERS

1 Vertical rolling stand
2 Center line of the rolling train
3 Vertical roll unit
4 Transverse heads of the vertical rolling stand
5 Uprights
6A Upper roll beam
6B Lower roll beam
7 Vertical rolls
8A Upper chocks
8B Lower chocks
9 Traverses
10A Upper actuating cylinder
10B Lower actuating cylinder
11 Return cylinder
12A Upper stationary measuring plates
12B Lower stationary measuring plates
12A' Upper stationary measuring plates, alternative arrangement
12B' Lower stationary measuring plates, alternative arrangement
13 Outer edges of the vertical rolls facing the rolled stock
14A Upper movable measuring plates
14B Lower movable measuring plates
14A' Upper movable measuring plates, alternative arrangement
14B' Lower movable measuring plates, alternative arrangement
S Control system
PG Position sensor
DG Pressure transmitter
$A_{kal}$ Calibrated initial distance
$A_{stat}$ Distance of the stationary reference surface from the center line of the rolling train
$A_{bew}$ Distance of the movable reference surface from the center line of the vertical roll
$D_W$ Diameter of the vertical roll

The invention claimed is:

1. A method for automatic calibration of vertical rolls of a vertical rolling stand, wherein each of the vertical rolls is supported in a vertical roll unit of a plurality of vertical roll units, wherein each vertical roll unit in the plurality of vertical roll units is adjustable with respect to a predetermined center line of several components arranged in a rolling train, the method comprising:

a) moving the plurality of vertical roll units into a calibration position transverse to the center line against at least one stationary stop of the vertical rolling stand, wherein the at least one stationary stop is a stationary reference surface that has a certain known position with respect to the center line and which is configured to interface with at least one movable reference surface that rests on at least one of the plurality of vertical roll units, b) calculating a calibrated initial distance (Akal) between the center line in the calibration position and an outer edge of one of the vertical rolls facing a rolled stock or between the center line in the calibration position and a center line of the one of the vertical rolls, and c) adjusting the vertical roll units to a defined operating position.

2. The method according to claim 1, wherein a calibration process is carried out for the plurality of vertical roll units including at least a first vertical roll unit and a second vertical roll unit arranged opposite, wherein the first and the second vertical roll unit are moved into the defined operating position after the calibration process with respect to the center line in such a way that the outer edges of the vertical rolls facing the rolled stock are at an equal distance from the center line.

3. The method according to claim 1, wherein a calibration process for each vertical roll of the vertical rolls is carried out separately and independently of the calibration process for an opposite vertical roll of the vertical rolls.

4. The method according to claim 1, wherein the calculation of the calibrated initial distance (Akal) is carried out in each case on a basis of a given diameter (DW) of the vertical rolls.

5. The method according to claim 1, wherein a diameter (DW) of the vertical rolls is calculated starting from a nominal diameter taking into account a wear-related change during a rolling process and the calculation of the calibrated initial distance (Akal) is based on the diameter (DW) of the vertical rolls.

6. The method according to claim 1, wherein the vertical roll unit is adjusted according to the method step a) aided by: at least one adjustment system and/or at least one return system.

7. The method according to claim 1, wherein reaching of the defined operating position is monitored by at least one measuring element.

8. The method according to claim 1, wherein the method step a) comprises that first, at least one first reference, the at least one first reference including at least the stationary reference surface having the certain known position, is brought into contact with the at least one movable reference surface provided on position is brought into contact with one of:

the vertical roll unit, or a component adjacent to the vertical roll unit and movable with the vertical roll unit with at least one second reference surface of a defined position, fixed in relation to the center line, on the vertical rolling stand.

9. The method according to claim 8, wherein displacement of the vertical roll unit according to the method step a) takes place over a first travel distance at an increased speed and over a second travel distance at a reduced speed until the at least one first reference surface and the at least one second reference surface touch each other.

10. The method according to claim 8, wherein an actuating force of mutually contacting reference surfaces is monitored by at least one pressure transmitter (DG), and is limited to a predetermined maximum value.

11. The method according to claim 1, wherein the vertical roll unit is adjusted into the defined operating position by at least one hydraulic adjustment system and/or by at least one hydraulic return system, wherein attainment of the defined operating position is monitored by at least one measuring element.

12. The method according to claim 1, wherein the method is carried out when the vertical roll stand is idle.

13. The method according to claim 2, wherein the calibration process for each vertical roll of the vertical rolls is carried out separately and independently from the calibration process for the opposite vertical roll of the vertical rolls.

14. A calibration arrangement on a vertical rolling stand in a rolling train for rolling metal products, having at least two vertical rolls which are each mounted in vertical roll units of a plurality of vertical roll units, wherein the plurality of vertical roll units define a rolling gap and wherein the plurality of vertical roll units are adjustable by at least one adjustment system and/or at least one return system with respect to a predetermined center line of several components arranged in the rolling train, wherein the calibration arrangement comprises at least one first reference surface of a defined position on one of: at least one vertical roll unit in the plurality of vertical roll units, or on a component which is movable with the at least one vertical roll unit, wherein the calibration arrangement comprises at least one second reference surface stationary with respect to the center line and configured to interface with the at least one first reference surface via movement of the at least one first reference surface, and a control system (S) by which, with at least one position sensor (PG) of the at least one adjustment system and/or of the at least one return system, an adjustment of the plurality of vertical roll units is configured to be effected transversely to the center line against the at least one second reference surface as a stationary stop of the vertical rolling stand for determining a calibrated starting position and for calculating a calibrated initial distance (Akal) between an outer edge of a vertical roll in the at least two vertical rolls that is directed towards a rolled stock and the center line or between a center line of the vertical roll in the at least two vertical rolls and the center line, and for determining an adjustment of the plurality of vertical roll units into a defined rolling position.

15. The calibration arrangement according to claim 14, wherein at least one first reference surface is provided at least in each case on an upper and/or on a lower chock of the vertical rolls and/or on an adjacent component movable with the vertical roll unit.

16. The calibration arrangement according to claim 14, wherein at least one second reference surface stationary with respect to the center line is provided at least on an upper and/or on a lower roll beam of the vertical rolling stand and/or in each case on transverse heads of the vertical rolling stand.

17. The calibration arrangement according to claim 14, wherein the at least one first reference surface and/or the at least one second reference surface is adjustable with respect to its position.

18. The calibration arrangement according to claim 14, wherein the at least one first reference surface and/or the at least one second reference surface are designed as adjustable and/or replaceable measuring plates.

19. The calibration arrangement according to claim 14, wherein the calibration arrangement further comprises at least one position sensor (PG) for monitoring a position of the vertical roll units.

20. The calibration arrangement according to claim 14, wherein at least one pressure transmitter (DG) is provided, via which an actuating force of the at least one first reference surface is configured to be limited against the at least one second reference surface.

* * * * *